United States Patent [19]

Heitmann et al.

[11] Patent Number: 4,659,414

[45] Date of Patent: Apr. 21, 1987

[54] APPARATUS FOR MANIPULATING UNITING BANDS IN MACHINES OF THE TOBACCO PROCESSING INDUSTRY

[75] Inventors: Bob Heitmann; Karl-Heinz Schlüter, both of Hamburg; Wolfgang Steiniger, Börnsen, all of Fed. Rep. of Germany

[73] Assignee: Hauni-Werke Körber & Co. Kg., Hamburg, Fed. Rep. of Germany

[21] Appl. No.: 623,184

[22] Filed: Jun. 21, 1984

[30] Foreign Application Priority Data

Jun. 29, 1983 [DE] Fed. Rep. of Germany ..... 3323393
Jan. 21, 1984 [DE] Fed. Rep. of Germany ..... 3402022

[51] Int. Cl.[4] ..... B32B 31/00; B31F 5/00; B44C 1/00; G03D 15/04

[52] U.S. Cl. ..... 156/361; 156/362; 156/505; 156/541; 156/584; 242/58.5

[58] Field of Search ..... 156/157, 159, 309.3, 156/313, 365, 505, 506, 507, 504, 361, 502, 541, 542, 579; 242/58.5, 58.6

[56] References Cited

U.S. PATENT DOCUMENTS

| | | | |
|---|---|---|---|
| 3,749,634 | 7/1973 | Krause | 156/505 |
| 3,896,820 | 7/1975 | Ludszweit et al. | 156/504 |
| 4,124,436 | 11/1978 | Pettis, Jr. et al. | 156/542 |
| 4,240,862 | 12/1980 | Ishiyama | 156/361 |
| 4,245,795 | 1/1981 | Ludszweit et al. | 242/56 R |
| 4,371,418 | 2/1983 | Krywiczanin et al. | 156/541 |
| 4,392,912 | 7/1983 | Horsley | 156/504 |

*Primary Examiner*—Donald Czaja
*Assistant Examiner*—Louis Falasco
*Attorney, Agent, or Firm*—Peter K. Kontler

[57] ABSTRACT

Webs of cigarette paper, filter wrapping paper or metallic or plastic foil in cigarette rod making, filter rod making or cigarette packing machines are spliced to each other by uniting bands which are removed from a strip-shaped flexible carrier and delivered to the splicing station by a pivotable lever, either in response to reciprocation of a carriage by hand or by a motor or in response to automatic actuation of a fluid-operated motor so that its piston rod performs forward and return strokes. Each uniting band is adhesive at both sides and the splicing station is located between the path of movement of the running web and the path of movement of a fresh web which latter is accelerated to the speed of the running web prior to start of the splicing operation.

26 Claims, 9 Drawing Figures

APPARATUS FOR MANIPULATING UNITING BANDS IN MACHINES OF THE TOBACCO PROCESSING INDUSTRY

BACKGROUND OF THE INVENTION

The present invention relates to tobacco processing machines in general, and more particularly to improvements in apparatus which can be used in such machines to manipulate uniting bands of paper or the like. Still more particularly, the invention relates to improvements in apparatus which can be used in cigarette rod making machines, filter rod making machines, cigarette packing machines and like machines for the making and/or processing of smokers' products to receive, to transport to and to apply adhesive-coated uniting bands to stationary or running webs of wrapping material at the web splicing stations of such machines.

It is well known to automatically or semiautomatically splice the leader of a fresh web of cigarette paper to the trailing portion of a running web when the supply of running web is nearly exhausted. Analogously, it is customary to splice the trailing end of a running web of wrapping material in a filter rod making machine to the leader of a fresh web so as to ensure that the operation of the machine need not be interrupted for the sole purpose of drawing a web from a fresh bobbin of wrapping material. The situation is analogous in many types of packing machines wherein webs of metallic and/or plastic foil are being drawn from bobbins for conversion into blanks which are thereupon converted into constituents of soft or hard packs for cigarettes, cigars, cigarillos or other smokers' products.

In many machines of the tobacco processing industry, the making of a splice between the trailing end of a stationary or running web and the leader of a fresh web involves the placing of a uniting band between the two webs and moving one of the webs sideways toward the other web. The uniting band is coated with adhesive at both sides so that one adhesive-coated side adheres to the trailing end of the running web and the other adhesive-coated side adheres to the leader of the fresh web. It is also customary to sever the trailing end of the running web immediately behind the thus obtained splice in order to separate the running web from the remnant of the respective (expired) bobbin, and to sever or trim the leader of the fresh web immediately ahead of the splice so as to reduce the length of the unnecessary portion of the fresh web. The uniting band is placed onto a suitable support which is disposed at the splicing station between the paths for the running web and the leader of the fresh web, and such uniting band is automatically separated from its support when it is caused to adhere to the two webs because the running web pulls the uniting band off the support. The placing of a uniting band onto the support at the splicing station must be carried out with skill and care in order to ensure that the uniting band is invariably detached from the support when one of its adhesive-coated sides is contacted by the running web as well as that the uniting band establishes a satisfactory bond between the running and fresh webs in order to ensure that the leader of the fresh web is actually entrained into the wrapping mechanism of a cigarette rod making machine or the like. Improper application of a uniting band at the splicing station can entail a prolonged stoppage of the machine which can result in pronounced losses in output. It must be borne in mind that a modern cigarette maker turns out up to and even in excess of 8000 cigarettes per minute.

OBJECTS AND SUMMARY OF THE INVENTION

An object of the invention is to provide a novel and improved apparatus which can reliably and repeatedly place each of a short or long series of adhesive-coated uniting bands in an optimum position at the splicing station of a cigarette rod making, filter rod making, cigarette packing or analogous machine of the tobacco processing industry.

Another object of the invention is to provide an apparatus which can be installed in existing tobacco processing or filter making machines to enhance the reliability of such machines and to reduce the intervals of idleness as a result of improper splicing of running webs to fresh webs of cigarette paper or the like.

A further object of the invention is to provide an apparatus which can properly position adhesive-coated uniting bands at the splicing station of a cigarette rod making, filter rod making or like machine in an optimum orientation for attachment to webs of wrapping material and which can effect such positioning either in response to manipulation by an attendant, semiautomatically or in a fully automatic way.

Another object of the invention is to provide an apparatus which can properly position uniting bands without necessitating even slight lowering of the speed of forward movement of the running web from its source of supply to the wrapping mechanism of the respective machine.

An additional object of the invention is to provide a novel and improved method of manipulating adhesive-coated uniting bands in cigarette rod making, packing, filter rod making and analogous machines of the tobacco processing industry.

Still another object of the invention is to provide the apparatus with novel and improved means for removing successive adhesive-coated uniting bands from their carrier.

A further object of the invention is to provide the apparatus with novel and improved means for synchronizing the operations of various constituents with those of the machine in which the apparatus is put to use.

Another object of the invention is to provide an apparatus which can manipulate all kinds of adhesive-coated uniting bands with the same degree of accuracy, predictability and reliability.

An additional object of the invention is to provide the apparatus with novel and improved means for locating successive uniting bands and the splicing station of a cigarette rod making, cigarette packing, filter rod making or analogous tobacco or filter material processing machine.

The invention is embodied in an apparatus for delivering discrete adhesive-coated uniting bands to a web splicing station in a tobacco processing machine or the like wherein the uniting bands adhere to and form a row of uniting bands on a strip-shaped flexible carrier which forms a reel of superimposed convolutions. The apparatus comprises means for unwinding the carrier from the reel stepwise so as to locate successive uniting bands of the row of such uniting bands in a first predetermined position, means for removing from the carrier that uniting band which occupies the first position, including means for advancing the uniting band from the first position to a second predetermined position, and means for transferring uniting bands from the second position to the splicing station. Separation of uniting bands from their carrier can take place as a result of transfer from the second position to the splicing station.

The uniting bands are preferably of the type having first and second adhesive-coated sides. The apparatus further comprises means for advancing discrete first and second webs of wrapping material along predetermined first and second paths at the opposite sides of the splicing station, and the transferring means is then arranged to deliver uniting bands to the splicing station in such orientation that the first and second adhesive-coated sides of the uniting band at the splicing station face the adjacent portions of the respective (first and second) paths.

The transferring means can comprise a uniting band holder and means for moving the holder along an arcuate path between the second position and the splicing station. Such moving means can comprise means for pivoting the holder about a predetermined (e.g., stationary) axis. For example, the moving means can comprise a lever and means for pivoting the lever back and forth about such axis. The pivoting means can include means for pivoting the lever back and forth through angles of at least substantially 180°.

The unwinding means can comprise an indexible rotary carrier-withdrawing member, a reciprocable input member, and means for converting reciprocatory movements of the input member into angular movements of the withdrawing member. The input member can constitute or comprise a carriage which is reciprocable along a substantially vertical path, and the withdrawing member can be mounted for indexing movements about a predetermined axis. The carrier can be provided with equidistant openings, e.g., in the form of notches, one for each uniting band on the carrier. In such apparatus, the withdrawing member can be provided with entraining means arranged to enter the openings of the carrier in response to indexing of the withdrawing member and to thereby draw the carrier off the reel. The converting means can comprise a ratchet wheel which is connected with the withdrawing member and is mounted on the carriage, a pawl which is pivotably mounted on the carriage and engages the ratchet wheel, and means for pivoting the pawl in a predetermined direction to index the ratchet wheel and the withdrawing member through a predetermined angle in response to movement of the carriage in a first direction (e.g., from a lower end position to a higher end position). The means for pivoting the pawl can include a device which pulls the pawl in the predetermined direction in response to movement of the carriage in the first direction. Such pulling device can include a fixed retainer and a tension spring or an analogous resilient element having a first portion connected to or cooperating with the retainer and a second portion connected to or cooperating with the pawl. Stop means can be provided on the carriage to limit the extent of pivotal movement of the pawl in the predetermined direction in response to movement of the carriage in the first direction. Furthermore, the apparatus can comprise resetting means for pivoting the pawl counter to the predetermined direction in response to movement of the carriage in a second direction counter to the first direction (e.g., from the upper end position to the lower end position). The resetting means can comprise a stationary abutment which is adjacent to the path of movement of the pawl during movement of the carriage in the second direction.

Means can be provided to block indexing of the ratchet wheel in a direction counter to that in which the ratchet wheel is indexed by the pawl.

As mentioned above, the transferring means can comprise a uniting band holder and means (e.g., a lever) for pivoting the holder between the second position for uniting bands and the splicing station. Such pivoting means can further comprise a shaft for the lever and for the holder on the lever, and cam and follower means for rotating the shaft in response to movement of the carriage from one toward the other end position to thereby pivot the lever and the holder from the second position to the splicing station. The cam and follower means can comprise a cam (e.g., a groove cam) which is provided on or in the shaft and a follower which is provided on the carriage and is arranged to track the cam. A torsion spring or other suitable means can be provided to bias the shaft in a direction to move the holder from the splicng station to the second position. The cam groove is preferably an endless cam groove which includes a first section extending in at least substantial parallelism with the axis of the shaft, a second section extending circumferentially of the shaft and having a first end portion communicating with the first end portion of the first section, and a spiral third section having a first end portion communicating with the second end portion of the second section and a second end portion communicating with the second end portion of the first section. A switching device (such as an elongated leaf spring one end portion of which is riveted, bolted or otherwise secured to the shaft) can be provided in the cam groove and serves to prevent movement of the follower from the third section directly into the first section of the cam groove, i.e., to ensure unidirectional tracking of the cam groove by the follower.

The means for moving the input member (e.g., for reciprocating the aforementioned carriage between an upper and a lower end position) can comprise a handle and/or motor means, depending on the desired or necessary degree of automation of the apparatus.

In one of the presently preferred embodiments of the improved apparatus, the removing means comprises a member (e.g., a one-armed lever) which is pivotable back and forth with reference to the transferring means about a predetermined (e.g., about a fixed) axis. The pivotable member is preferably provided with a carrierengaging rotary element (such as an elastic biasing roller) which is remote from the predetermined axis and can be used to urge successive uniting bands against a holder of the transferring means when such holder is ready to receive a uniting band which is held in the second position. The uniting band holder can be arranged to move along an endless path (e.g., along a circular path in a substantially horizontal plane) and in a single direction from the second position to the splicing station and back to the second position, and the means (e.g., a transmission) for moving the holder along such path can further comprise means for pivoting the pivotable member of the removing means back and forth at least once between the first and second positions during each movement of the holder from the second position to the splicing station and back to the second position. Still further, the just mentioned moving means can comprise means for actuating the unwinding means so as to move a uniting band to the first position during each movement of the holder from the second position to the splicing station and back to the second position.

The unwinding means can comprise means for locating successive uniting bands in the first position in a plurality of successive stages, e.g., in two stages so that the carrier is advanced by half a pitch during each ofthe aforementioned stages, i.e., by half the distance between the centers of two neighboring uniting bands of the row of uniting bands on the carrier.

The aforementioned moving means is preferably arranged to move the unwinding means in synchronism with the transferring means and with the removing means so that the pivotable member of the removing means is pivoted back and forth once during each stage of advancement of a uniting band to the first position and that the holder is moved from the second position to the splicing station during the first stage and from the splicing station back to the second position during the second stage of advancement of a uniting band to the first position.

The means for operating the transferring means in synchronism with the unwinding and removing means can comprise a fluid-operated motor, such as a double-acting hydraulic or pneumatic cylinder and piston unit, whereby the reciprocatory movements of the piston rod of such unit initiate all movements which are necessary to unwind the carrier from its reel, to move successive uniting bands to the first position, to move succesive uniting bands from the first to the second position, and to transfer successive uniting bands from the second position to the splicing station.

The just outlined apparatus further comprises a source of fresh bobbins each of which contains a supply of a web of wrapping material, means (such as a plurality of guide rollers) for positioning discrete first and second webs of wrapping material in predetermined first and second paths at the opposite sides of the splicing station, means for advancing the web in one of the paths with attendant gradual expiration of the respective bobbin, means for replacing expired bobbins with fresh bobbins, and means for monitoring the webs and bobbins and including means for generating signals which are transmitted to the operating means. The monitoring means can comprise a group of at least three signal generators one of which serves to monitor the threading of a fresh web into the apparatus, another of which ascertains the existence or the absence of need for replacement of a bobbin, and a further of which serves to monitor one or more stages of each bobbin exchange. The monitoring means can further comprise means (e.g., a proximity detector switch) for generating signals which initiate return strokes of the aforementioned piston rod.

The monitoring means can further include means (e.g., a photocell or another suitable photoelectric detector) for monitoring the transfer of uniting bands between the removing means and the transferring means and means (e.g., a solenoid-operated valve) for controlling the operating means in response to such signals. In addition to the photocell, the operating means can be influenced by a signal generator which monitors the position of the transferring means and by a signal generator which monitors the sources (bobbins) of webs which are being spliced at the splicing station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
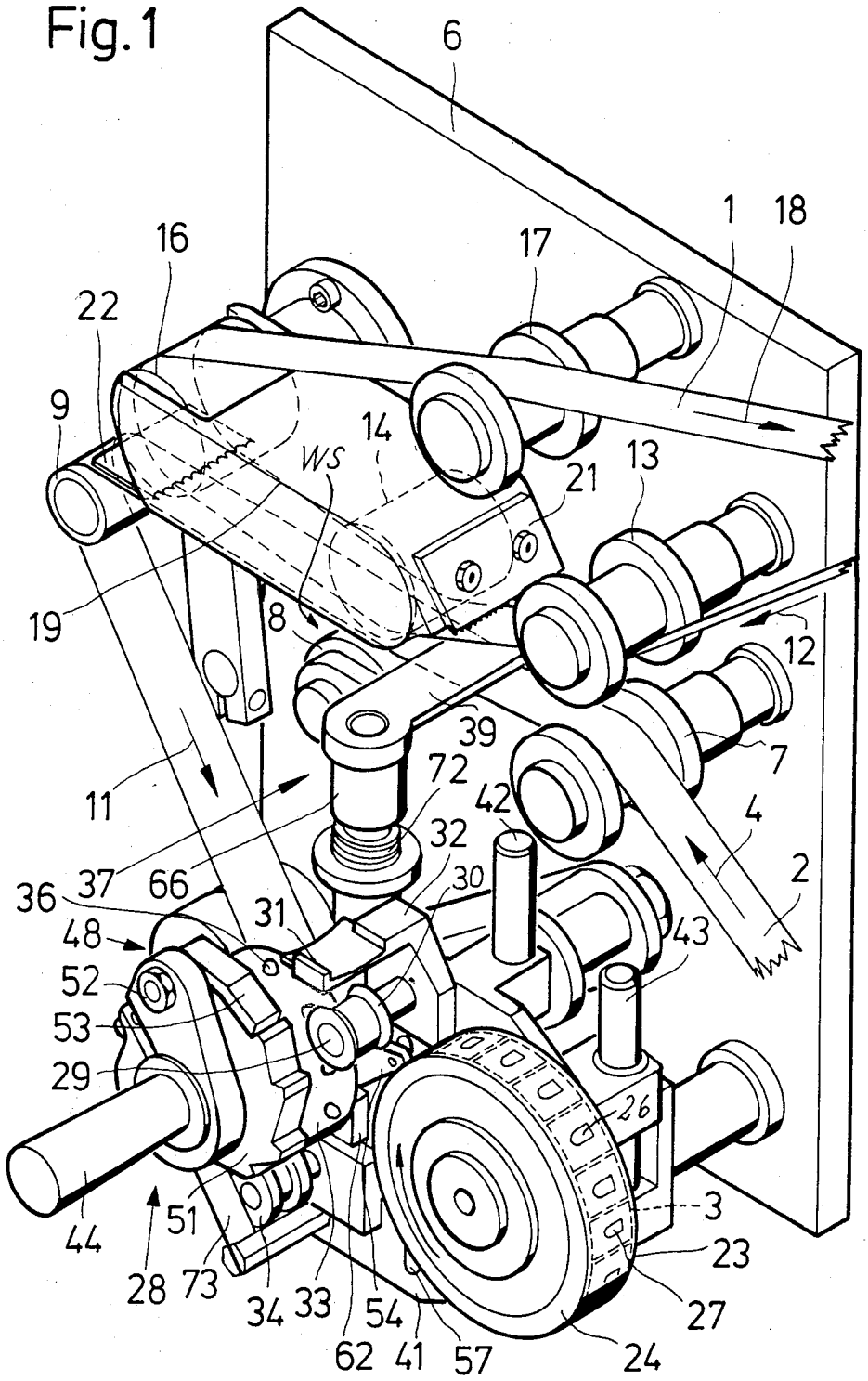
FIG. 1 is a perspective view of an apparatus which embodies one form of the invention.

The apparatus which is shown in FIGS. 1 to 4 serves to deliver discrete uniting bands 3 from one side of a strip-shaped carrier 23 to a web splicing station WS where the uniting bands are used to attach an expiring web 1 of cigarette paper or another wrapping material to a fresh web 2 of such wrapping material. To this end, both sides of each uniting band 3 are coated with a suitable adhesive. The apparatus of FIGS. 1 to 4 is installed in or incorporated into a cigarette rod making machine, e.g., a machine known as GARANT or a machine known as PROTOS (both manufactured and sold by the assignee of the present application).

In FIG. 1, a fresh web 2 of cigarette paper is properly threaded through the apparatus and is assumed to be ready to advance in the direction which is indicated by arrow 4 on its way from a fresh bobbin or reel (such as the reel 2 in the drawing of commonly owned U.S. Pat. No. 4,245,795 granted Jan. 20, 1981 to Ludszeweit et al. and hereinafter called Ludszeweit for short) and over guide rollers 7, 8 and 9 which are rotatably mounted on an upright plate-like support 6. From the guide roll 9, the fresh web 2 advances in the direction of arrow 11 toward a suitable accelerating device, such as the one disclosed in commonly owned U.S. Pat. No. 3,896,820 granted July 29, 1975 to Ludszeweit et al. The expiring web 1 is supplied by an expiring bobbin (see the bobbin 2*a* in the patent to Ludszeweit) and advances in the direction of arrow 12 over guide rollers 13, 14, 16 and 17 which are rotatably mounted on the support 6. The arrow 18 indicates the direction in which the web 1 is fed to the wrapping mechanism of the cigarette rod making machine. The guide roller 14 is mounted in a housing 19 which is pivotable about the axis of the guide roller 16. The rollers 8 and 14 form part of a splicing device which serves to splice the web 1 to the web 2 by means of an adhesive-coated uniting band 3 which, at the time the splicing operation is to begin, is located at the splicing station WS, namely in the gap or clearance between the paths for the webs 1 and 2 in the region between the guide rollers 8 and 14. The housing 19 further supports a knife 21 which serves to sever the expiring web 1 in response to clockwise pivoting of the housing, as viewed in FIG. 1, so that the portion of the web 1 which is located to the left of the knife 21 is severed from the respective (expired) reel and is attached to the freshly formed leader of the fresh web 2. Such freshly formed leader is obtained because the support 6 carries a second knife 22 which automatically severs the web 2 between the guide rollers 8 and 9 when the housing 19 is pivoted clockwise, as viewed in FIG. 1, in order to cause the rollers 8 and 14 to perform a splicing operation. The freshly formed leader of the web 2 then adheres to the trailing end of the web 1 and is advanced therewith in the direction of arrow 18, i.e., into the wrapping mechanism of the cigarette rod making machine. The remainder of the web 2 (ahead of the knife 22) is caused to descend into a suitable collecting receptacle. Such receptacle is shown at 57 in the drawing of Ludszeweit which further shows the equivalents of knives 21, 22 as well as the means for advancing the running web from the splicing station on to the wrapping mechanism.

Figure 2:
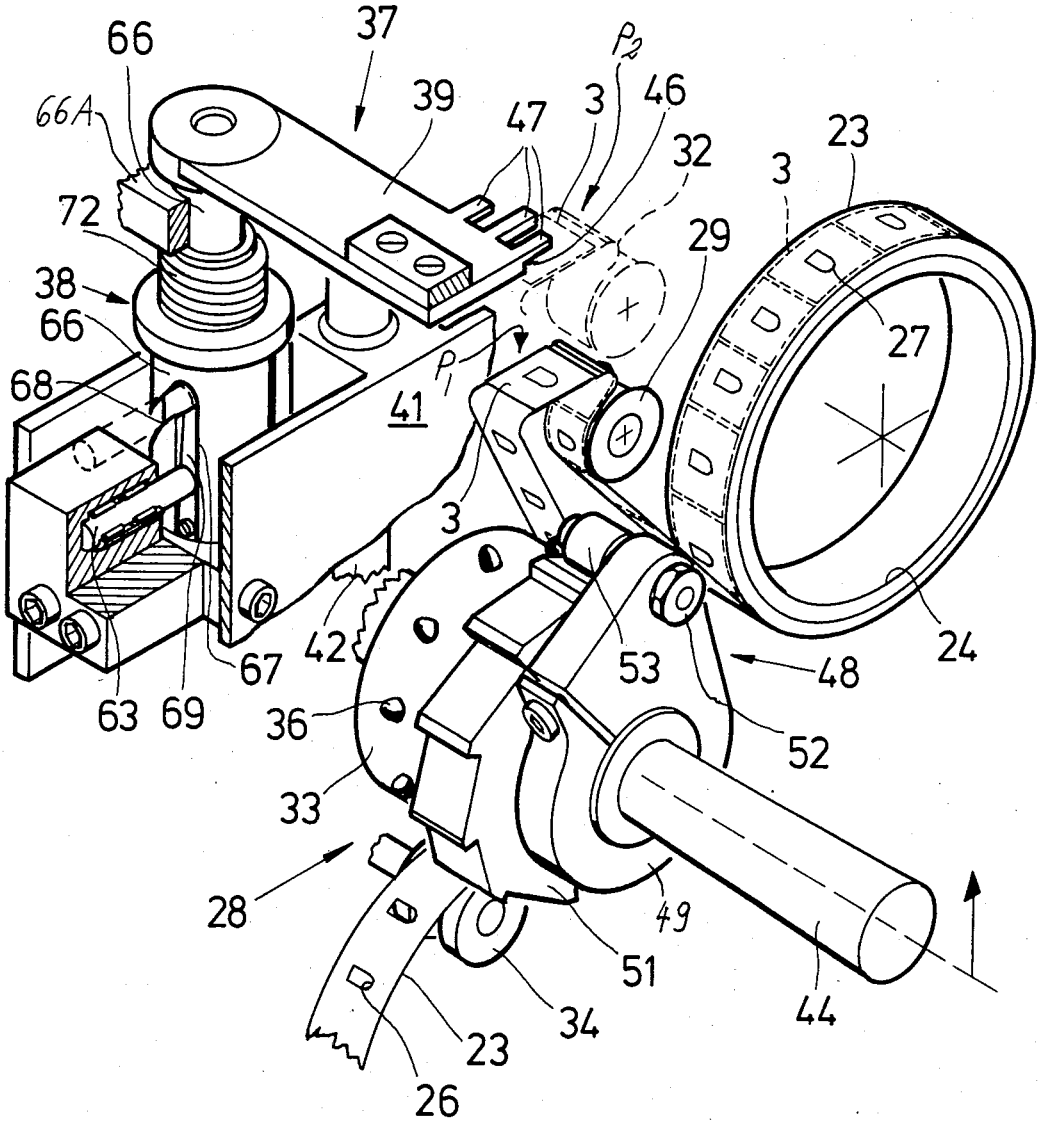
FIG. 2 is an enlarged fragmentary perspective view of a detail in the apparatus of FIG. 1, showing a uniting band in the first position by solid lines and in the second position by broken lines.

The carrier 23 of uniting bands 3 is stored in convoluted condition in the form of a reel 24 and is withdrawn from the reel in stepwise fashion, always through a distance matching that between the centers of two neighboring uniting bands 3 of the row of such uniting bands at one side of the carrier 23. The carrier 23 is formed with openings in the form of notches 26, one for each uniting band 3 thereon, and such openings are preferably formed by stamping or punching so that the partly removed material of the carrier and uniting bands forms flaps 27 each having a marginal portion adhering to the carrier and to the respective uniting band. The provision of openings 26 facilitates the unwinding of the carrier 23 from the reel 24 for the purpose of locating successive foremost uniting bands 3 in a predetermined position as shown at $P_1$ in FIG. 2. The means for withdrawing successive increments of the carrier 23 from the reel 24 is shown at 28 and is designed to index the reel 24 in a clockwise direction, as viewed in FIG. 1, so that the carrier 23 is trained over the relatively narrow and sharp flanges 30 of a guide roller 29 and over the concave top surface 31 of a uniting band removing means 32 in the form of a vertically movable bracket before it contacts the peripheral surface of a rotary indexible withdrawing member 33 having entraining means in the form of hemispherical or otherwise configurated protuberances 36 entering the openings 26 of the carrier 23 downstream of the concave top surface 31, i.e., downstream of the location where successive uniting bands 3 are detached from the carrier. The flanges 30 have relatively sharp edges in order to reduce the area of contact with the uniting bands 3 on the carrier 23. As can be seen in FIG. 2, the flanges 30 contact the exposed sides of successive uniting bands 3 but the surface 31 of the removing means 32 contacts the uncoated (non-adhesive) underside of the adjacent portion of the flexible carrier 23. An idler roller 34 causes the carrier 23 to remain in contact with the peripheral surface of the withdrawing member 33 so that at least one protuberance 36 extends into the adjacent opening 26 and ensures that the carrier 23 is advanced by a step of predetermined length whenever the member 33 is indexed through a predetermined angle (in a clockwise direction, as viewed in FIG. 2). The leader of the carrier 23 (i.e., that portion of the carrier which has been relieved of the uniting bands 3) is caused to descend into a suitable collecting receptacle, not shown.

The unwinding means 28 further comprises a reciprocable input member 41 and means (including a ratchet wheel 51 and a pawl 48) for converting reciprocatory movements of the input member 41 into angular movements of the withdrawing member 33. The input member 41 further transmits motion to a transferring means 37 which serves to receive discrete uniting bands 3 from the removing means 32 (after the latter has advanced a band 3 and the corresponding portion of the carrier 23 from the first position $P_1$ to a second position $P_2$ which is indicated in FIG. 2 by broken lines) and to deliver such uniting bands to the splicing station WS. The transferring means 37 comprises a lever 39 which serves to pivot a holder 47 about a fixed axis in response to movement of the input member 41 (which is a carriage mounted for movement along vertical tie rods 42, 43 on the support 6) between a first and a second end position. The spindle for the reel 24 is mounted on the carriage 41, the same as the unwinding means 28 and the uniting band removing means 32. The means for reciprocating the carriage 41 along the tie rods 42, 43 comprises a handle 44 which can be grasped by an attendant in order to move the carriage from its lower end position to its upper end position and back to the lower end position. Such movement of the carriage 41 from and back to its lower end position suffices to index the withdrawing member 33 through a predetermined angle so as to place the foremost uniting band 3 the position $P_1$ above the concave surface 31 of the band removing means 32, to advance the band removing means from the solidline to the broken-line position of FIG. 2 with the result that the uniting band is transferred from the carrier portion above the concave surface 31 onto the convex underside of the holder 47 which has several parallel band-contacting fingers, to move the lever 39 from the position of FIG. 2 to the position of FIG. 3 in order to transfer the uniting band 3 from the position $P_2$ (on the carrier portion above the surface 31) to the splicing station WS, and to return the unwinding means 28 and the band removing means 32 to their idle or starting positions of FIG. 1. The fingers of the holder 47 on the lever 39 are provided with notches 46 which receive a portion of the band removing means at the station where the uniting band 3 assumes the position $P_2$.

The shaft of the handle 44 rotatably supports the aforementioned pawl 48 of the motion converting means. This pawl has a bearing sleeve 49 for the ratchet wheel 51 which is rigidly connected to or made integral with the withdrawing member 33. The radially outermost portion of the pawl 48 carries a pivot member 52 for a tooth-shaped pallet 53 which can transmit motion to the adjacent tooth of the ratchet wheel 51 when the pawl 48 is caused to turn clockwise, as viewed in FIG. 1, but which merely rides over a tooth of the ratchet wheel 51 when the pawl is caused to turn in the opposite direction.

The means for pivoting the pawl 48 in a clockwise direction, as viewed in FIG. 1, comprises a lever 54 which is fixedly secured to or made integral with the bearing sleeve 49 and is adjacent to that end face of the withdrawing member 33 which is nearer to the support 6. The means for pulling the lever 54 in a clockwise direction, as viewed in FIG. 4, comprises a resilient element in the form of a tension spring 56 one end portion of which is attached to the lever 54 and the other end portion of which is attached to a fixed retainer in the form of a stud 58 affixed to the support 6 and extending through a vertical slot 57 of the carriage 41. The lever 54 further abuts against a resetting means 61 in the form of a fixed abutment provided on the support 6 and extending through a second vertical slot 59 of the carriage 41.

When the handle 44 is caused to move the carraige 41 upwardly, the tension spring 56 of the pulling means for the pawl 48 causes the lever 54 (and hence the pawl 48) to turn in a clockwise direction, as viewed in FIG. 1 or 2, whereby the pallet 53 engages the adjacent tooth of the ratchet wheel 51 and indexes the latter (together with the withdrawing member 33) in the same direction so that one or more protuberances 36 of the member 33 withdraw a predetermined length of the carrier 23 from the reel 24 and thereby move the foremost uniting band 23 to the position $P_1$ above the concave surface 31 of the band removing means 32. The ratchet wheel 51 ceases to turn in a clockwise direction when the lever 54 reaches and abuts against a stop 62 on the carriage 41. As mentioned above, such mode of transmitting motion from the carriage 41 to the withdrawing member 33 ensures that the carrier 23 is advanced through a distance matching that between the centers of two neighboring uniting bands 3 on the carrier. The foremost uniting band 3 is then located at a level above the concave surface 31 of the withdrawing means 32 so that the latter can be lifted to move the uniting band thereabove from the position $P_1$ to the position $P_2$ and to thus transfer the foremost uniting band from the carrier 23 onto the fingers of the holder 47 on the lever 39 of the transferring means 37. That position of the removing means 32 in which its concave surface 31 properly supports the carrier portion for the foremost uniting band 3 is shown in FIG. 2 by solid lines. The holder 47 of the lever 39 is then located at a level exactly above the surface 31 of the removing means 32.

When the carriage 41 thereupon continues to move toward its upper end position, the removing means 32 shares such upward movement to approach the holder 47 but the indexing of the withdrawing member 33 is terminated because the lever 54 (which is connected with the pawl 48) abuts against the stop 62 on the carriage 41. The extent of upward movement of the carriage 41 subsequent to completed indexing of the ratchet wheel 51 and withdrawing member 33 is exaggerated in FIG. 2 for the sake of clarity. When the carriage 41 reaches its upper end position, the withdrawing means 32 assumes the broken-line position of FIG. 2 and the uniting band 3 thereabove then assumes the position $P_2$, i.e., it can be taken over by the holder 47 for transfer to the splicing station WS in response to pivoting of the lever 39 from the position of FIG. 2 to the position of FIG. 3. The force with which the underside of the uniting band 3 in the position $P_2$ adheres to the carrier 23 is less pronounced than the force with which the upper side of such uniting band adheres to the undersides of fingers forming part of the holder 47 so that the latter detaches the uniting band from the carrier 23 in response to pivoting of the lever 39 from the position of FIG. 2 to the position of FIG. 3. This can be readily achieved by appropriate treatment of the respective side of the carrier 23, i.e., by a treatment such that the bond between the carrier and the uniting bands 3 is not very pronounced.

Figure 3:
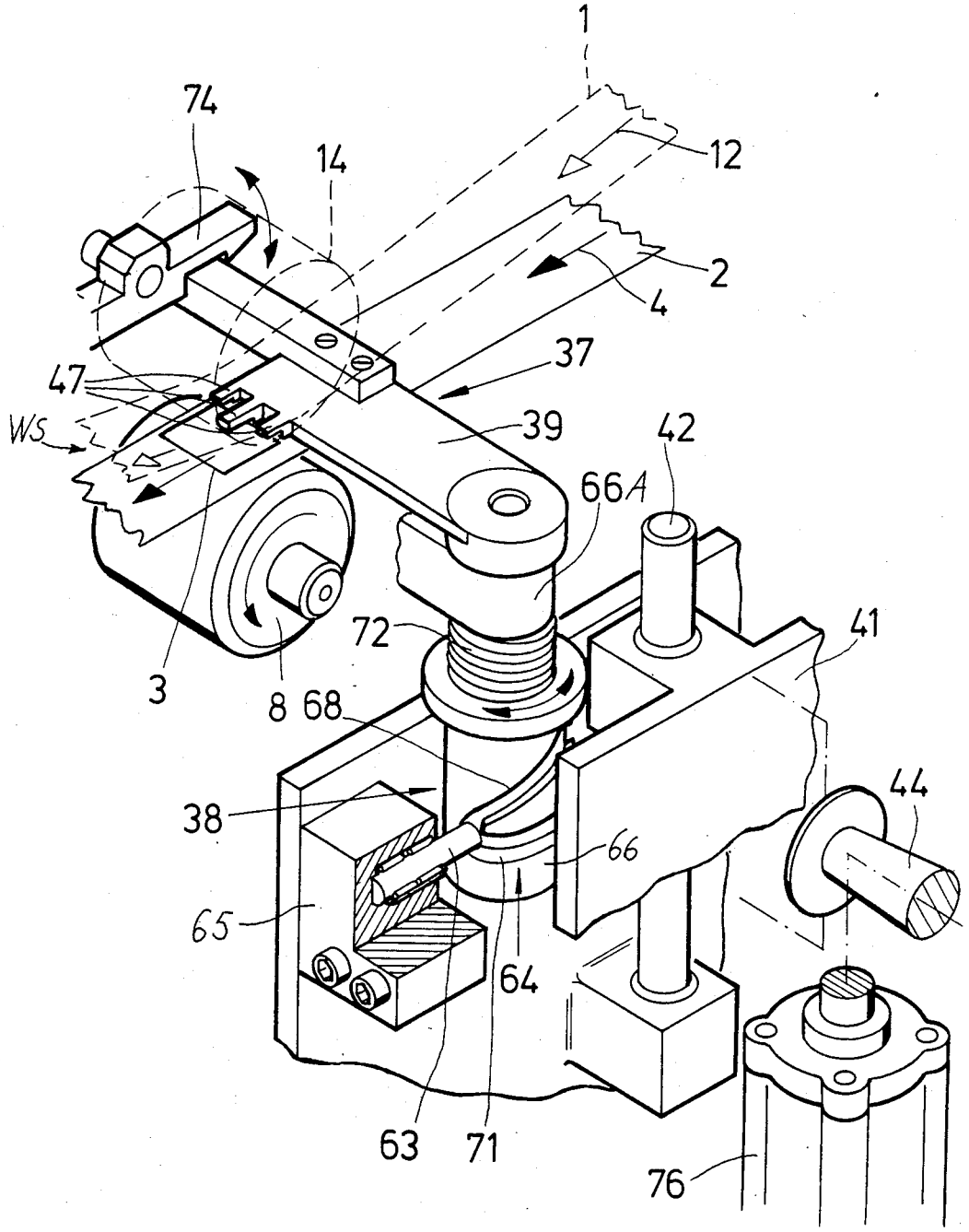
FIG. 3 is an enlarged fragmentary perspective view of another detail in the apparatus of FIG. 1, showing the parts which deliver uniting bands to the splicing station.

The means for pivoting the lever 39 and its holder 47 between the positions of FIGS. 2 and 3 is shown at 38. Such pivoting means derives motion from the carriage 41 while the latter is caused to move from its upper end position back to the lower end position of FIG. 1. As can be seen, for example, in FIG. 3, the pivoting means 38 comprises a rotatable pin-shaped follower 63 which is mounted in a suitable bracket 65 on the carriage 41 and a portion of which extends into a cam groove 64 machined into the peripheral surface of a vertical camshaft 66 on the support 6 or another stationary part of the apparatus. The upper end portion of the camshaft 66 is connected with the lever 39. The reference character 66A denotes an arm which defines a bearing sleeve for the shaft 66 immediately above a torsion spring 72 constituting a means for yieldably biasing the shaft 66 in a clockwise direction, i.e., so as to urge the lever 39 to the position of FIG. 2.

The cam groove 64 in the periphery of the shaft 66 has an axially parallel vertical section 67, a spiral section 68 the upper end of which communicates with the upper end of the section 67, and a circumferentially extending third section 71 one end of which communicates with the lower end of the section 68 and the other end of which communicates with the lower end of the section 67. An elastic tongue-like switching device 69 of springy metallic sheet material or the like is installed in the section 67 in such a way that its lower end portion is affixed to the camshaft 66 at the junction of the sections 67, 71 and that its upper end portion tends to move radially outwardly from the upper end portion of the section 67. When the carriage 41 is caused to move upwardly in response to exertion of a push or pull upon the handle 44, the follower 63 slides upwardly in the vertical section 67 of the cam groove 64 whereby the angular position of the camshaft 66 and lever 39 remains unchanged. The upper end position of the follower 63 is shown in FIG. 2 by broken lines. During its upward movement, the tip of the follower 63 depresses the switching device 69 into the section 67 but the upper end portion of the switching device 69 snaps outwardly in view of its innate resiliency and thus prevents downward movement of the follower 63 in the section 67. The top end face of the switching device 69 then provides a guide for movement of the follower 63 into the spiral section 68 of the cam groove 64 when the carriage 41 is caused to move downwardly. This enables the follower 63 to turn the shaft 66 in a counterclockwise direction, as viewed in FIG. 2, through 180° (or through another selected angle) while the carriage 41 moves downwardly whereby the holder 47 (with a uniting band 3 adhering to its convex underside) moves from the position of FIG. 2 to that which is shown in FIG. 3, i.e., the uniting band leaves the position $P_2$ and is transferred to the splicing station WS. The torsion spring 72 stores energy while the follower 63 slides in the spiral section 68 of the cam groove 64 but this spring cannot immediately return the shaft 66 to the angular position of FIG. 2 when the follower enters the adjacent end portion of the circumferentially extending section 71 because the lever 39 is temporarily held in the position of FIG. 3 by a detent lever 74 which releases the lever 39 after the housing 19 is pivoted clockwise, as viewed in FIG. 1, in order to start a splicing operation.

The means for disengaging the detent lever 74 from the lever 39 not later than upon completed splicing of the webs 1 and 2 to each other is not shown in FIGS. 1 to 4. Such starting means can include a detector which monitors the diameter of the expiring reel (for the web 1) and transmits a signal to pivot the housing 19 and to thereupon disengage the lever 74 from the lever 39 with a requisite delay when the diameter of the expiring reel reaches a predetermined minimum value. Once the detent lever 74 has been pivoted in a counterclockwise direction, as viewed in FIG. 3, the torsion spring 72 is free to turn the camshaft 66 clockwise through 180° whereby the tip of the follower 66 slides in the section 71 of the cam groove 64 and moves back to its starting position, namely into the lower end portion of the vertical section 69. The holder 47 of the lever 39 then again assumes the position of FIG. 2 and is ready to receive the next uniting band 3 from the carrier portion above the surface 31 of the band removing means 32.

The convex underside of the holder 47 imparts to the uniting band 3 thereon a concavoconvex shape so that the leader of the uniting band, which is being transferred from the second position $P_2$ to the splicing station WS, cannot bend or flex during rapid transfer into the gap between the rollers 8 and 14 at the splicing station. As can be seen in FIG. 3, the fingers of the holder 47 merely contact a small (rear) portion of the upper side of the uniting band 3 thereon so that the major part of each of the two adhesive-coated sides of such band is available for contacting the respective web (1 or 2) when the housing 19 is pivoted to move the roller 14 toward the roller 8. The aforediscussed convex shape of the underside of the holder 47 has been found to ensure highly desirable stabilization of uniting bands 3 during their transfer from the position $P_2$ to the splicing station WS.

Figure 4:
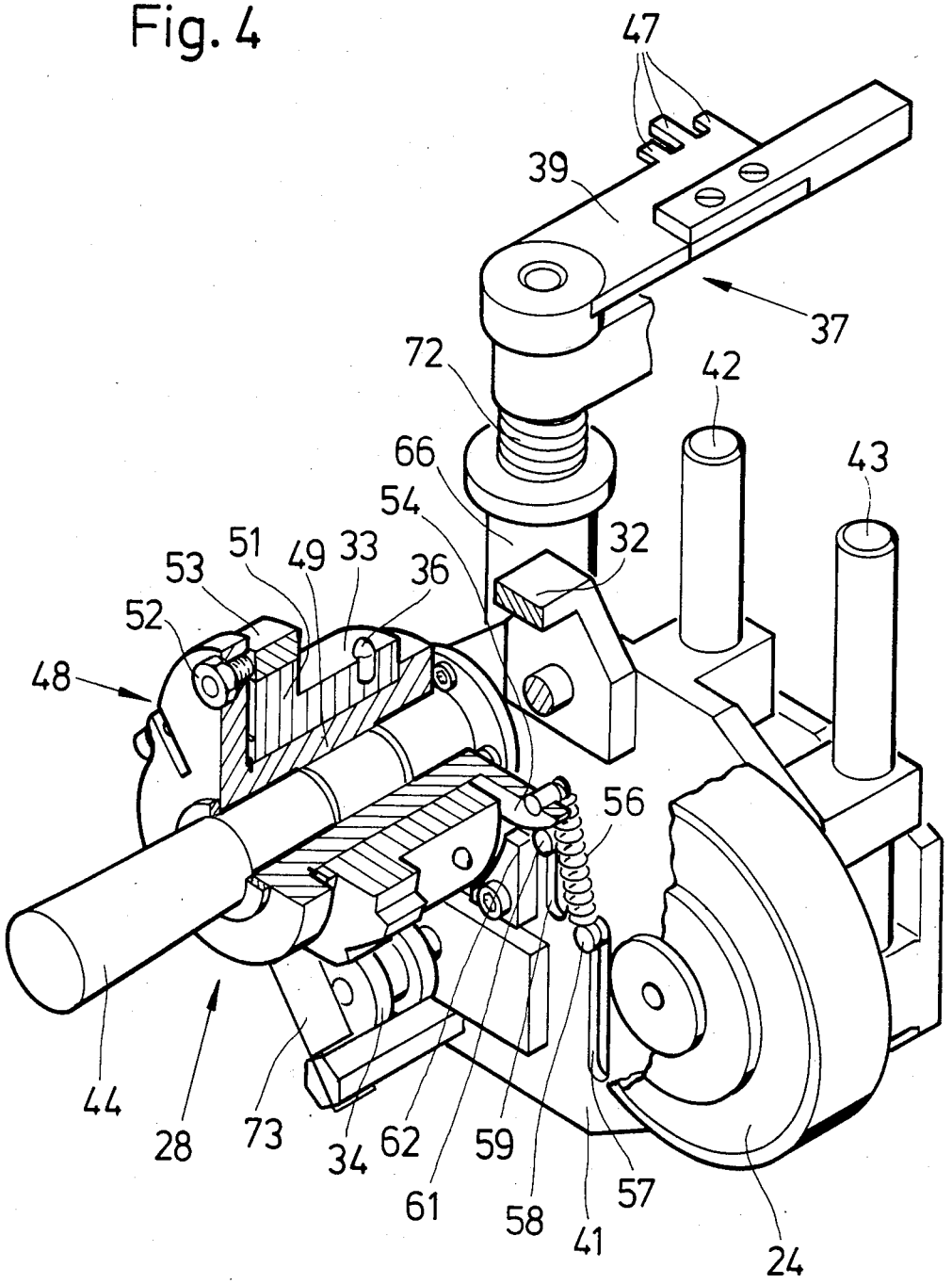
FIG. 4 is an enlarged fragmentary perspective view of a further detail in the apparatus of FIG. 1, showing the means for drawing the carrier of uniting bands off its reel.

When the handle 44 causes the carriage 41 to move downwardly, the lever 54 continues to abut against the resetting means 61 of the support 6 so that this lever pivots in a counterclockwise direction, as viewed in FIG. 4, and the pallet 53 rides over one of the teeth on the ratchet wheel 51 while the pawl 48 returns to its starting position. A resilient blocking device 73 (e.g., a leaf spring) is mounted on the carriage 41 and serves as a means for further ensuring that the ratchet wheel 51 cannot share the angular movement of the lever 54 under the action of the resetting means 61. The inclination of the free end portion of the blocking device 73 is such that it does not offer much resistance to indexing of the ratchet wheel 51 by the pallet 53 when the lever 54 is pivoted by the tension spring 56, i.e., while the handle 44 is caused to move the carriage 41 upwardly.

The aforementioned detent lever 74 is disengaged from the lever 39 for the holder 47 when the monitoring device detects that the diameter of the expiring reel (for the web 1) has been reduced to a minimum permissible value and/or when the fresh web 2 is accelerated to the exact speed of the running web 1. The manner in which the fresh web 2 can be accelerated to the exact speed or very close to the speed of the running web 1 is fully disclosed in the aforementioned commonly owned U.S. Pat. No. 3,896,820.

Pivoting of the housing 19 and its roller 14 in a clockwise direction, as viewed in FIG. 1, also entails a severing of the running web 1 by the knife 21 behind the splicing station WS and a severing of the fresh web 2 by the knife 22 in front of the splicing station. Thus, the web 1 is severed from the expired reel and the leader of the fresh web 2 is trimmed so that it does not extend well ahead of the splice which is formed by the uniting band 3 between the two webs. The detent lever 74 is disengaged from the lever 39 (e.g., in response to pivoting of the housing 19 in a direction to move the roller 14 toward the roller 8) as soon as the uniting band which has been delivered by the holder 47 is properly attached to the webs 1 and 2; the torsion spring 72 is then free to turn the camshaft 66 clockwise and to thereby return the holder 47 to a position above the band removing means 32.

If the operation of the apparatus is to be automated, either entirely or in part, the handle 44 can be replaced with or provided together with a motor 76 (see FIG. 3), e.g., a double-acting hydraulic or pneumatic cylinder and piston unit, which can be actuated to move the carriage 41 from the lower end position to the upper end position and back to the lower end position. The motor 76 can be started to move the carriage 41 from and back to the lower end position in response to a signal which indicates that a fresh reel of wrapping material has been inserted into the cigarette rod making machine in lieu of an expired reel or during a later stage of conversion of the then running web into the tubular wrapper of a cigarette rod, filter rod or the like. Thus, the apparatus of FIGS. 1 to 4 can be operated by hand or by motor means, i.e., manually or automatically, depending on the wishes of the manufacturer of smokers' articles.

An advantage of the transferring means 37 is that the lever 39 can be moved in a substantially horizontal plane so as to move successive uniting bands 3 from the second position $P_2$ to the splicing station WS even if the paths for the webs 1 and 2 at the splicing station are rather close to one another. As can be seen in the upper part of FIG. 3, the paths of the webs 1 and 2 at the opposite sides of the splicing station WS are inclined with reference to each other andthe lever 39 of the transferring means 37 is arranged to introduce a uniting band 3 into the splicing station WS by moving counterclockwise, as viewed in FIG. 3, so as to advance the leader of the uniting band 3 deeper into the progressively narrowing gap between the webs 1 and 2 in the region between the guide rollers 8 and 14. While it is possible to shorten or lengthen the paths of back-and-forth pivotal movements of the lever 39 about the fixed axis of the camshaft 66, the illustrated lever is arranged to pivot back and forth through angles of 180°.

An advantage of the apparatus which is shown in FIGS. 1 to 4 is that the operator who is in charge of ensuring that a fresh uniting band 3 is always located at the splicing station WS when the web 1 is about to be spliced to the web 2 need not actually locate the uniting band 3 at the splicing station. The transfer of uniting bands 3 from the carrier 23 onto the holder 47 and the transport of such holder from the position $P_2$ the splicing station WS take place automatically and always with the same degree of accuracy and predictability, as long as the attendant in charge ensures that the handle 44 is moved to an extent which is required to advance the carriage 41 from its lower end position to the upper end position and back to the lower end position. This greatly reduces (and practically eliminates) the likelihood of improper positioning of uniting bands 3 at the splicing station WS, i.e., the operation of the splicing mechanism is much less dependent on the skill and carefulness of the attendants. All an attendant has to do in order to effect a timely transfer of a uniting band 3 from the carrier 23 to the splicing station WS is to move the handle 44 up and down. If the handle 44 is used in addition to the motor 76, or if the motor 76 is used in lieu of the handle 44, the task of the attendant is even simpler, i.e., the attendant is merely required to start the motor 76 (so that the piston rod of this motor performs a forward and return stroke and thereby moves the carraige 41 up and down) ahead of the time when the supply of web 1 has expired.

The provision of notches 26 or analogous openings in the carrier 23 is optional but desirable because the entraining means 36 of the withdrawing member 33 are capable of positively advancing the carrier 23 through distances which are necessary to move successive uniting bands 3 of the row of such bands on the carrier 23 to the first position $P_1$ in response to each actuation of the unwinding means 28.

While it is also within the purview of the invention to provide a separate handle or a separate motor to effect movements of the lever 39 between the splicing station WS and the position $P_2$, the feature that such movement of the lever 39 takes place in response to downward movement of the carriage 41 is preferred at this time because it contributes to simplicity, compactness and reliability of the improved apparatus. The aforedescribed camshaft 66 with its groove cam 64 and the pin-shaped follower 63 also contribute to simplicity and compactness of the apparatus, especially of the means for pivoting the holder 47 along an arcuate path between the splicing station WS and the position $P_2$.

FIGS. 5 to 9 illustrate the details of a second apparatus wherein many parts which are identical with or analogous to the corresponding parts of the apparatus of FIGS. 1 to 4 are denoted by similar reference characters plus 100. The main difference between the two apparatus is that the apparatus of FIGS. 5 to 9 is fully automated so that the transfer of successive uniting bands 103 from the carrier 123 to the splicing station WS between the webs 101, 102 of wrapping material need not be observed and/or initiated and/or carried out by an attendant.

Figure 5:
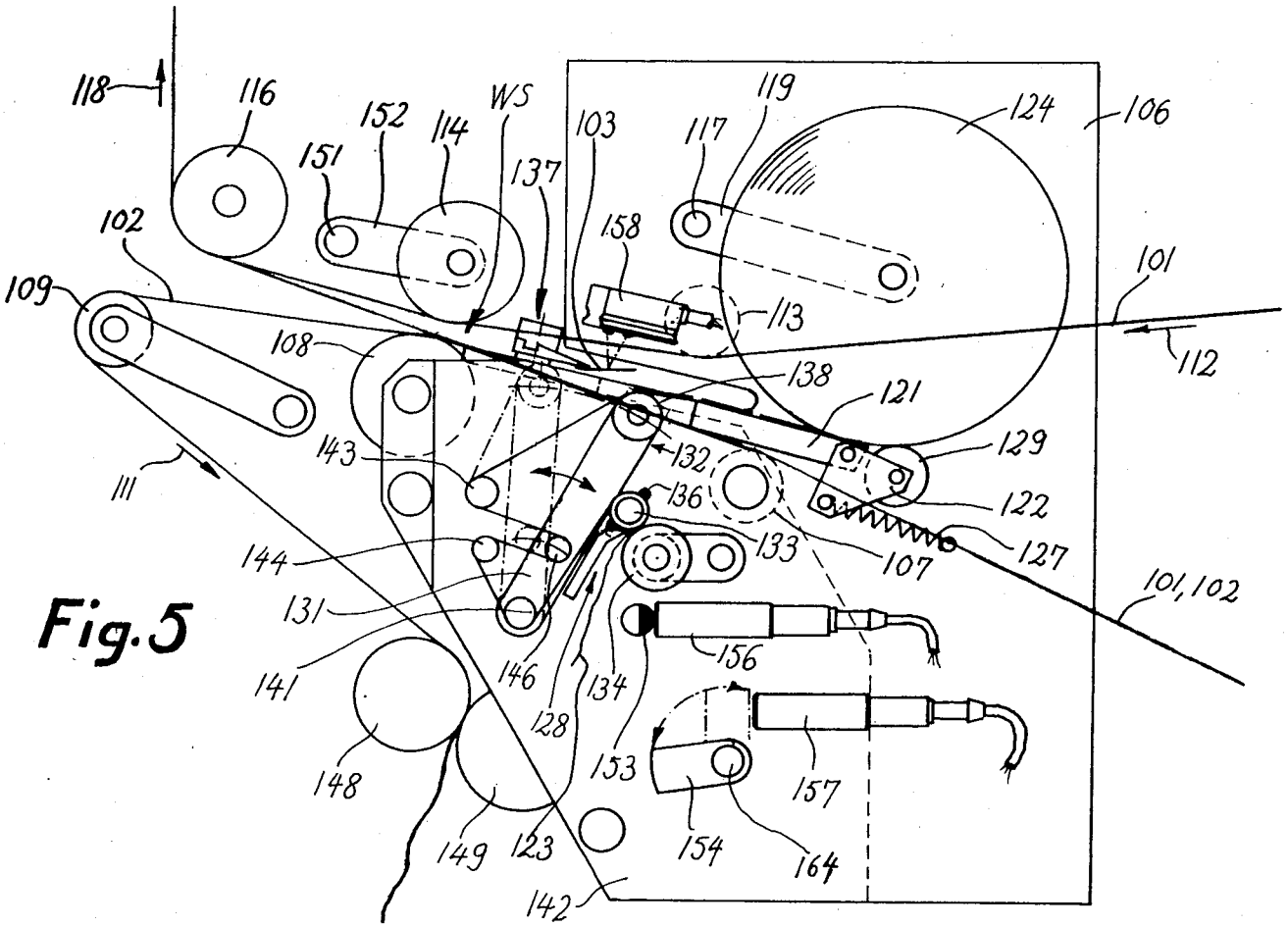
FIG. 5 is a schematic side elevational view of a modified apparatus wherein the transfer of uniting bands from the source to the splicing station is effected in a fully automatic way.
Figure 6:
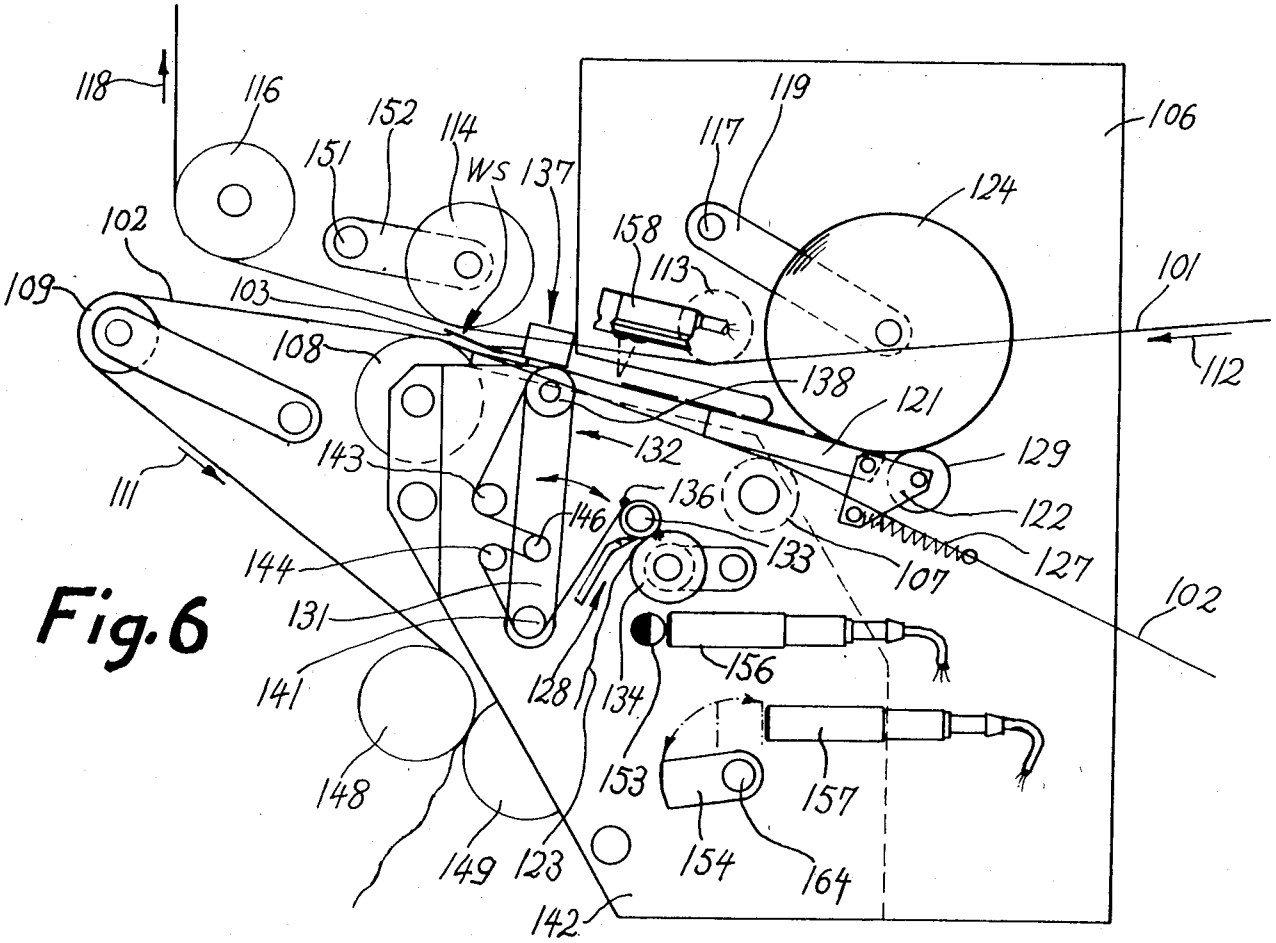
FIG. 6 illustrates the structure of FIG. 5, with certain parts shown in different positions.

Referring first to FIGS. 5 and 6, the reel 124 of convolutions of the strip-shaped carrier 123 is mounted at the free end of a one-armed lever 119 which is secured to a horizontal pivot member 117 on a plate-like support 106. The outer side of the lowermost part of the outermost convolution of the carrier 123 on the reel 124 rests on a plate-like supporting member 121 the right-hand end portion of which has a pivot for a bearing 122 for a supporting roller 129. The bearing 122 is biased in a clockwise direction, as viewed in FIGS. 5 and 6, by a tension spring 127 which is attached to a retainer on the support 106 so that the roller 129 is biased against the adjacent portion of the outermost convolution of the carrier 123.

Figure 7:
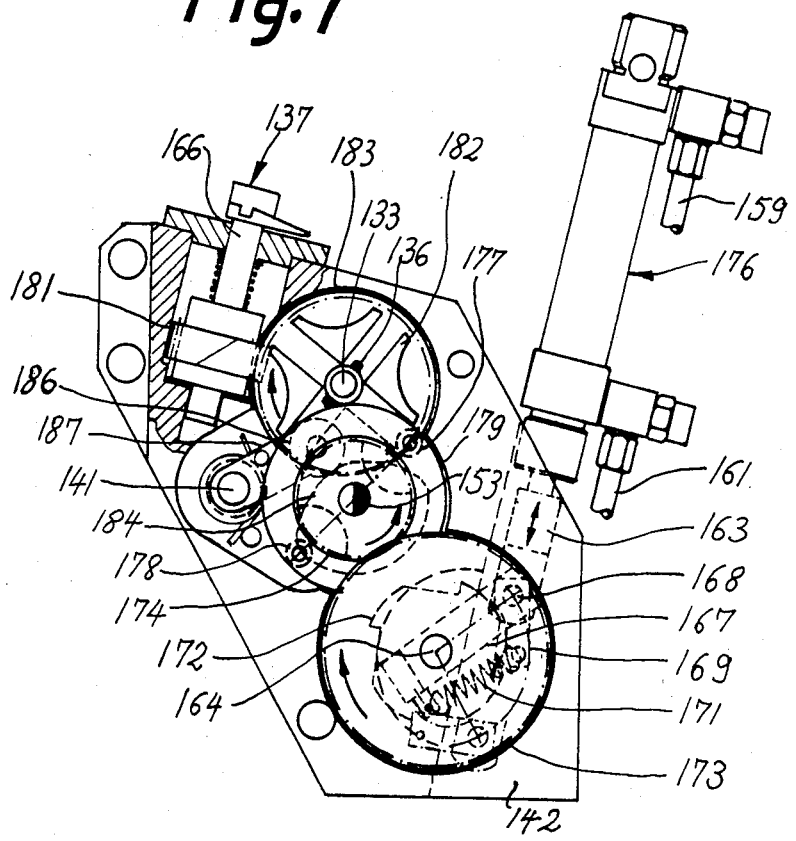
FIG. 7 is a schematic sectional view of a transmission in the apparatus of FIGS. 6 and 7.

The means 128 for unwinding the carrier 123 stepwise from the reel 124 includes a withdrawing shaft 133 (a smaller-diameter version of the withdrawing member 33 shown in FIG. 1) which is provided with entraining protuberances 136 and cooperates with an idler roller 134. The uniting band removing means 132 which supports successive uniting bands 103 on the carrier 123 in a first position and attaches successive uniting bands to the holder 147 on the lever 139 of the transferring means 137 in a second position 130 (see FIG. 8) comprises a one-armed lever 131 mounted on an input shaft 141 and carrying at its free end a roller 138 having a peripheral layer of rubber or other elastomeric material. The input shaft 141 constitutes one output shaft of a transmission which is installed in a gear case 142 or another suitable housing and the details of which are shown in FIG. 7. An end portion of the input shaft 141 extends from the gear case 142 and carries the lever 131 of the removing means 132; at the same time, a part of such end portion of the input shaft 141 constitutes a pulley or guide for the carrier 123. The carrier 123 is further trained over several stationary idler rollers or non-rotatable guide members 143, 144 as well as over a bolt or pulley 146 which is mounted on the lever 131 and loops a portion of the carrier 123 between the pulleys or bolts 143, 144.

The webs 101 and 102 of wrapping material are paid out by two discrete bobbins, such as the bobbins 2 and **2*a* shown in the Pat. No. 4,275,795 to Ludszeweit. The bobbins are mounted on an indexible disc which is shown at 7 in the Pat. No. 4,275,795 and which can be turned through 180° to cause the expiring and fresh bobbins to switch positions in a manner as fully disclosed in this patent. The running web 101 is trained over rollers (combined guide and deflecting means) 113, 114 and 116, and the fresh web 102 is trained over rollers (combined guide and deflecting means) 107, 108 and 109. The leader of the fresh web 102 extends into the nip of two accelerating rollers 148 and 149**.

The rollers 108 and 114 constitute two components of the splicing mechanism and, to this end, the roller 114 is mounted on a lever 152 which is pivotable about the axis of a horizontal shaft 151 in the frame of the cigarette rod making or filter rod making machine which utilizes the improved apparatus. The remaining parts of the splicing mechanism can be constructed and can operate in a manner as disclosed, for example, in the Pat. No. 4,275,795 or 3,896,820.

The gear case 142 contains and/or includes additional components including a timing shaft 153 and a resetting lever 154. The timing shaft 153 cooperates with a first signal generator 156 in the form of a proximity detector switch, and the lever 154 cooperates with a second signal generator 157 which also constitutes a proximity detector switch.

The presence, absence and positioning of uniting bands 103 on the transferring means 137 are monitored by a monitoring or detecting means in the form of a photocell 158 which is an element of a control circuit (shown in FIG. 9) further including the aforementioned proximity detector switches 156 and 157.

The gear case 142 contains numerous additional elements which serve to transmit motion to the transferring means 137, removing means 132, unwinding means 128, timing shaft 153 and resetting lever 154. All such elements receive motion from a common prime mover in the form of a fluid-operated motor here shown as a double-acting pneumatic cylinder and piston unit having a cylinder (see FIGS. 7 and 9) and a reciprocable piston rod 163. The two chambers of the cylinder 176 respectively receive or discharge compressed air by way of conduits 159, 161, and the flow of air into and from such chambers is regulated by a 4/2-way solenoid-operated valve 162. The piston rod 163 is articulately connected, by way of a motion transmitting lever (not specifically shown because concealed in FIG. 7), with a shaft 164 which is rigid with such lever and has an end portion extending from the gear case 142 and rigidly connected with the resetting lever 154. The shaft 164 is further non-rotatably connected with a pawl 167 the free end portion of which carries a pivot pin 168 for a pallet 169 biased by a tension spring 171 and engaging the adjacent tooth of a ratchet wheel 172. The latter is free to rotate relative to but is mounted on the shaft 164. A spur gear 173, which is rigid with the ratchet wheel 172, meshes with a second spur gear 174 which is coaxial with and affixed to the timing shaft 153. The ratio of the gears 173, 174 is one-to-two. The timing shaft 153 is further rigidly connected with an indexing wheel 179 which carries two indexing rollers 177, 178 cooperating with the indexible wheel 182 of a geneva movement serving to intermittently index the withdrawing shaft 133 and its entraining means 136. The wheel 182 of the geneva movement is affixed to the shaft 133 externally of the gear case 142. The shaft 133 is further connected with a worm wheel 183 which meshes with a worm 181 of the shaft 166 for the transferring means 137. The transmission ratio of the worm wheel 183 and worm 181 is one-to-two.

The timing shaft 153 is further rigidly connected with a disc cam 184 whose peripheral surface is tracked by a roller follower 186 mounted at the free end of a lever 187 which is non-rotatably secured to the input shaft 141 externally of the gear case 142. As mentioned above, the input shaft 141 supports the lever 131 of the band removing means 132.

Figure 9:
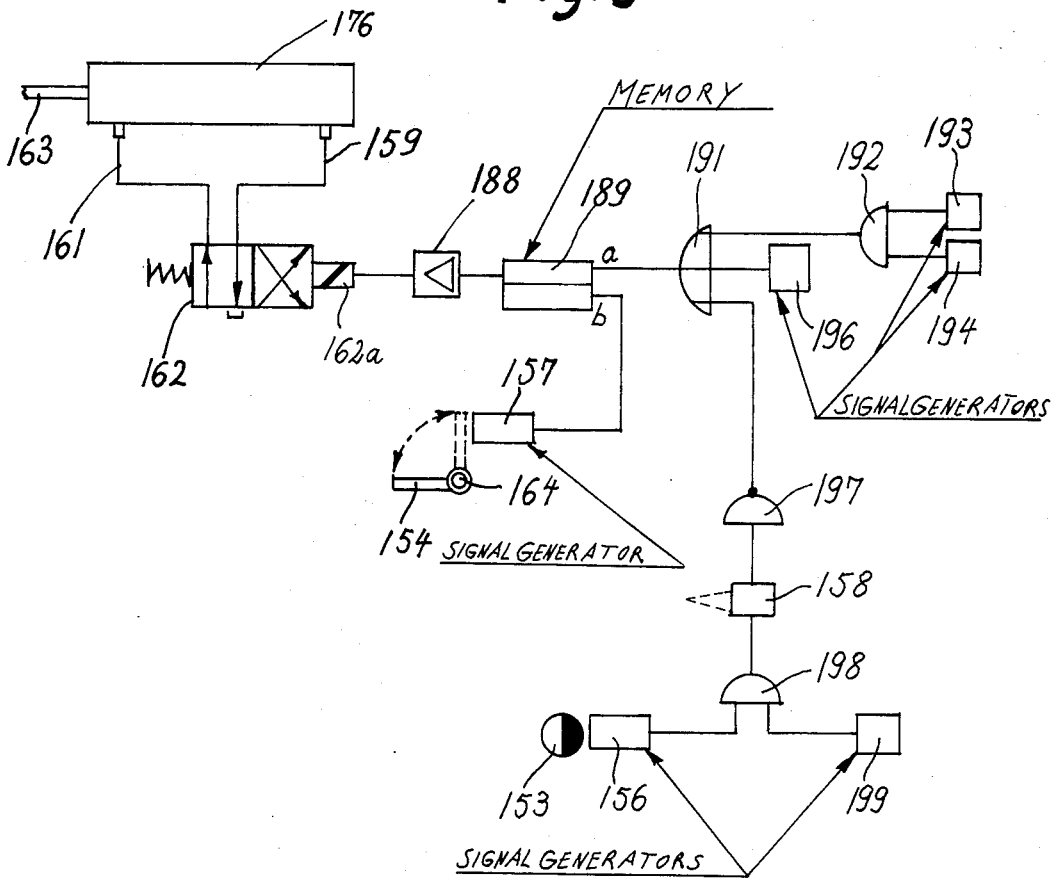
FIG. 9 is a circuit diagram of the controls in the apparatus of FIGS. 5 to 8.

FIG. 9 shows that the solenoid 162*a* of the regulating valve 162 can receive signals from the output of a memory 189, here shown as a flip-flop, by way of an amplifier 188. The setting input a of the flip-flop 189 is connected with the output of an OR gate 191 having three inputs one of which is connected with the output of an AND gate 192. One input of the AND gate 192 is connected to the output element of a first signal generator 193 which monitors the threading of the fresh web 102 into the machine and transmits a signal when the web 102 is properly threaded so that it can be accelerated and spliced to the running web 101. The other input of the AND gate 192 is connected with a second signal generator 194 which indicates whether or not the aforementioned disc which supports the bobbins for webs 101, 102 is ready for indexing through 180° or another suitable angle. The signal generators 193, 194 can constitute limit switches, pulse generators or like monitoring means and can be installed in the apparatus of U.S. Pat. No. 4,275,795 to Ludszeweit to monitor the state of the threading means for the fresh web 102 and the state of the means for jointly indexing the two bobbins, respectively.

Another input of the OR gate 191 is connected with a signal generator 196 which serves to generate a signal when the splicing of the webs 101, 102 to each other is completed.

The third input of the OR gate 191 is connected with the output of the transducer of the photocell 158 by way of an inverter 197. The input of the photocell 158 is connected with the output of a further AND gate 198 having two inputs one of which is connected to the aforementioned signal generator 156. The latter transmits a signal when the timing shaft 153 assumes a predetermined angular position. The other input of the AND gate 198 is connected with an additional signal generator 199 which generates a signal when the indexing of the two bobbins is completed. The signal generator 199, too, can be installed in an apparatus of the type disclosed in U.S. Pat. No. 4,245,795 to Ludszeweit.

The resetting input b of the flip-flop 189 is connected with the output of the proximity detector switch 157 which is actuatable by the resetting lever 154 on the shaft 164.

Figure 8:
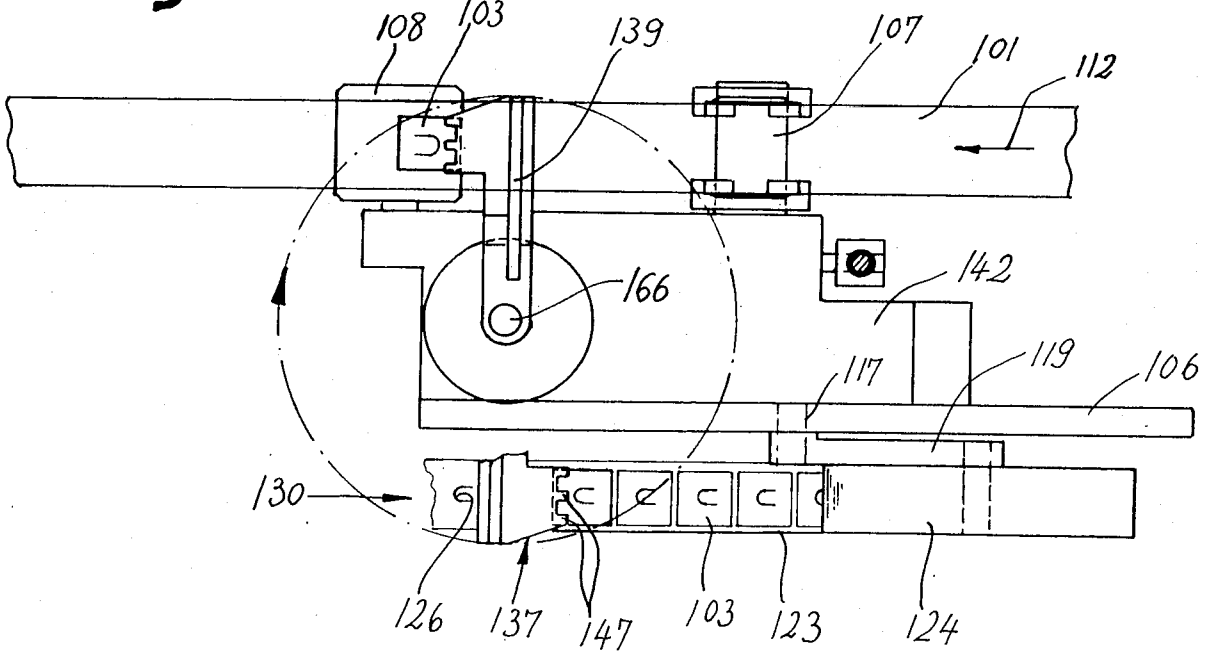
FIG. 8 is a fragmentary schematic plan view of the apparatus of FIGS. 5 to 7.

The operation of the apparatus which is shown in FIGS. 5 to 9 is as follows:

It is assumed that the holder 147 of the lever 139 is located in the position 130 of FIG. 8 (corresponding to the position $P_2$ of FIG. 2) and that a uniting band 103 adheres to the convex undersides of the fingers of such holder. The position 130 is remote from the path of movement of the running web 101 which is being fed into the wrapping mechanism of the cigarette rod making or filter rod making machine.

The disc 7 which is shown in the drawing of U.S. Pat. No. 4,245,795 to Dudszeweit is assumed to support a freshly inserted bobbin which pays out the web 101. Such bobbin is placed onto the lower spindle of the disc 7, as viewed in the drawing of Ludszeweit. At the same time or thereafter, the expired bobbin (see the bobbin 2*a* in the drawing of Ludszeweit) is removed from the disc 7 and a fresh bobbin (with the web 102) is placed onto the corresponding upper spindle of the disc 7. The leader of the web 102 is thereupon threaded through the apparatus in a manner as also disclosed by Ludszeweit, and the disc 7 is indexed through 180° in the next step so that the running web 101 is being paid out by the bobbin on the upper spindle and the bobbin for the web 102 is supported by the lower spindle of the disc 7. Such indexing of the just discussed disc establishes between the paths of the webs 101 and 102 a gap or space (see FIG. 6) which is located at the splicing station WS, i.e., in the region between the rollers 108 and 114. In the next step, the lever 139 is caused to pivot clockwise through an angle of 180° to assume the position which is shown in FIG. 8 and to thus transfer the uniting band 103 on the fingers of its holder 147 from the (second) position 130 to the splicing station WS. Such pivoting of the lever 139 is initiated and carried out in the following way:

The web 101 continues to run (arrow 112 in FIGS. 5 and 6) from the respective (upper) spindle on the disc 7 of Ludszeweit along the roller 114 and on into the wrapping mechanism (arrow 118 in FIGS. 5 and 6). When the diameter of the expiring bobbin (for the web 101) is reduced to a predetermined value and the leader of the fresh web 102 is properly threaded into the apparatus, the corresponding signal generators 194 and 193 transmit signals to the respective inputs of the AND gate 192 whose output transmits a signal to the OR gate 191. The latter transmits a signal to the setting input a of the flip-flop 189 which energizes the solenoid 162*a* of the regulating valve 162 by way of the amplifier 188. The valve 162 then admits compressed air into the conduit 159 and permits air to escape from the cylinder 176 via conduit 161. Consequently, the piston rod 163 moves outwardly and rotates the shaft 164 for the resetting lever 154 through an angle of 90°. The shaft 164 further causes the pawl 167 to complete a quarter turn and to index the ratchet wheel 172 and spur gear 173. In view of the one-to-two ratio between the spur gears 173 and 174, the indexing wheel 179 (which engages the indexible wheel 182 of the geneva movement), the disc cam 184 and hence also the timing shaft 153 are caused to turn through 180°. The indexible wheel 182 of the geneva movement is turned through 90° together with the worm wheel 183 and the withdrawing shaft 133. Since the transmission ratio between the worm wheel 183 and the worm 181 of the shaft 166 is one-to-two, the shaft 166 is caused to turn through 180°. The roller follower 186 then tracks a radially outwardly extending portion of the peripheral surface of the disc cam 184 so that the lever 187 on the shaft 141 is pivoted in a counterclockwise direction.

The just described movements of various components of the transmission in the gear case 142 bring about the following movements which directly affect the transport of the uniting band carrier 123 i.e., the movements which take place outside of the gear case. The lever 139, whose holder 147 carries a uniting band 103, is pivoted through an angle of 180°, as viewed in FIG. 8, and transfers such uniting band into the space between the webs 101, 102, i.e., into the splicing station WS. Such position of a uniting band 103 at the splicing station WS is shown in FIG. 6.

While the lever 139 performs the just described angular movement, the lever 131 of the uniting band removing means 132 is pivoted from the end position of FIG. 5 to the starting position of FIG. 6 by turning in a counterclockwise direction. This causes the withdrawing shaft 133 to advance the carrier 123 by half a pitch (11 mm). When the piston rod 163 assumes its fully extended position, the resetting lever 154 on the shaft 164 moves to the broken-line position of FIG. 9 and thereby causes the proximity detector switch 157 to transmit a signal to the resetting input b of the flip-flop 189 whereby the latter deenergizes the solenoid **162*a* and the valve 162 causes the piston rod 163 to return to its retracted position. Thus, the deenergized solenoid 162*a* causes the valving element of the regulating valve 162 to connect the conduit 159 with the atmosphere and to connect the conduit 161 with the source of pressurized fluid with resulting return movement of the piston rod 163 to its retracted position. The piston rod 163 thereby causes the pallet 169 to ride over a tooth of the ratchet wheel 172 and to reassume its normal starting position. The angular position of the ratchet wheel 172 remains unchanged, e.g., due to the provision of a leaf spring analogous to the blocking device 73 shown in FIG. 1. The shaft 164 pivots the resetting lever 154** through an angle of 90° in a clockwise direction.

In the next step, the fresh web 102 is accelerated (e.g., in the apparatus of U.S. Pat. No. 3,896,820 to Ludszeweit et al.) so that its speed matches or closely approximates the speed of the running web 101. Such step is followed by the actual splicing step, i.e., the shaft 151 is caused to pivot the lever 152 and the roller 114 thereon in a clockwise direction, as viewed in FIG. 6, so that the webs 101 and 102 adhere to the respective sides of the uniting band 103 on the holder 147 and separate the uniting band from such holder. The signal generator 196 transmits a signal if the splicing operation has been completed according to the schedule and in a proper way, and such signal is caused to reach the solenoid **162*a* of the regulating valve 162 via OR gate 191, flip-flop 189 and amplifier 188. The piston rod 163 is caused to perform a fresh working stroke by moving downwardly, as viewed in FIG. 7, whereby the lever 139 is pivoted again through 180° (and again in a clockwise direction, as viewed in FIG. 8) so that its holder 147 returns to the position 130 and is free to accept a fresh uniting band 103. Moreover, the shaft 133 again withdraws the carrier 123 through a distance which equals one-half of a pitch so that the foremost uniting band 103 assumes the first position and can be delivered onto the holder 147 of the lever 139**.

When the lever 139 returns the holder 147 to the position 130 of FIG. 8, the roller follower 186 reaches a radially inwardly sloping portion of the peripheral surface of the disc cam 184 so that the lever 131 begins to pivot in a clockwise direction and the roller 138 (which performs the function of the band removing means 32 shown in FIG. 1) moves the foremost uniting band 103 on the carrier 123 against the fingers of the holder 147. The remainder of pivotal movement of the lever 131 is used to effect full separation of the uniting band 103 on the holder 147 from the carrier 123.

The resetting lever 154 then causes the signal generator 157 to transmit a signal to the resetting input b of the flip-flop 189 so that the piston rod 163 is retracted and the various parts reassume their starting positions in the aforedescribed manner.

The timing shaft 153 causes the proximity detector switch 156 to transmit a signal when the transferring means 137 reassumes its starting position (i.e., when the holder 147 is located at the position 130 of FIG. 8). To this end, the proximity detector switch 156 transmits a signal to the corresponding input of the AND gate 198 when the corresponding portion **153*a* (e.g., a permanent magnet) on the shaft 153 faces the switch 156, namely when the transferring means 137 is held in the starting position. The apparatus also comprises means for monitoring the presence and transfer of a uniting band 103 from the carrier 123 (by means of the roller 138) onto the fingers of the holder 147 while the holder 147 is held in the position 130. This is initiated by the signal generator 199 which transmits a signal to the corresponding input of the AND gate 198 when the disc 7 in the U.S. Pat. No. 4,245,795 to Ludszeweit is indexed through 180°. The signal at the output of the AND gate 198 then activates the photocell 158 which ascertains the presence or absence of a uniting band 103 on the holder 147 while the latter dwells in the position 130 of FIG. 8. If no uniting band is present at the station (position 130) whence the lever 139 is to transfer such uniting band to the splicing station WS, the photocell 158 does not transmit a signal to the inverter 197 and the latter transmits a signal to the corresponding input of the OR gate 191. This initiates at least one further outward movement of the piston rod 163. The interval of time which is available for forward and return strokes of the piston rod 163 prior to start of the next splicing operation is sufficiently long to enable the piston rod 163 to perform at least two or more than two (preferably three) forward and return strokes which normally suffices to ensure the placing of a uniting band 103 onto the fingers of the holder 147 in the position 130. If the holder 147 still fails to receive a satisfactory uniting band, or does not receive a uniting band, or the uniting band is not properly attached thereto, the third signal from the inverter 197** is or can be used to stop the main prime mover (not shown) of the machine.

It will be noted that, in contrast to the apparatus of FIGS. 1 to 4, the apparatus of FIGS. 5 to 9 employs a uniting band removing means 132 with a lever 131 which is pivotable back and forth about the axis of the input shaft 141 and that actual transport or advancement of uniting bands 103 from the first position to the second position 130 is effected by the elastic biasing roller 139 at that end of the lever 131 which is remote from the input shaft 141. The movements of the lever 139 of the transferring means 137 are synchronized with the movements of the roller 138 and with those of the unwinding means 128 in such a way that the lever 139 completes an angular movement (in a single direction in contrast to the lever 139 in the apparatus of FIGS. 1 to 4) through 360° while the unwinding means 128 effects a two-stage advancement of the foremost uniting band 103 into the range of the roller 138 and the removing means 132 locates the foremost uniting band 103 in the position 130 for transfer onto the holder 147 of the lever 139. As can be seen in FIG. 8, the holder 147 engages the leader of the foremost uniting band 103 on the carrier 123 and thereupon turns in a clockwise direction to advance the thus engaged uniting band along an arc of 180° while the free (rear) end of the uniting band trails the holder. When the angular movement of the holder 147 through 180° is completed, the free end of the uniting band 103 at the splicing station WS is the leading end, as considered in the direction of advancement of the web 101 (arrow 112). This invariably ensures that the uniting band 103 on the holder 147 remains flat, even if the underside of the holder 147 is not convex or concave.

The operation of the apparatus which is shown in FIGS. 5 to 9 can be automated to any desired extent. This depends on the number, nature and distribution of signal generating monitoring devices which can influence the valve 162 and hence the motor 176. Thus, the signal generator 193 can generate a signal when the threading of a fresh web 102 through the apparatus is completed, the signal generator 194 can monitor the position of the disc or turntable which carries the bobbins of webs 101, 102, the signal generator 196 can transmit a signal when the splicing of the webs 101, 102 to each other is completed, and the signal generator 158 can transmit a signal to denote the position of the uniting band 103 with reference to the holder 147 at the splicing station WS. As explained above, the signal generator 158 is in a condition to transmit a signal to the inverter 197 when the AND gate 198 receives signals from the signal generators 156 (position of the lever 139) and 199 (completion or lack of completion of transfer of a uniting band 103 onto the holder 147).

All of the illustrated and described embodiments of the improved apparatus share the advantage that the positioning of uniting bands 3 or 103 at the splicing station WS is not dependent on the skill and/or attentiveness of the operator. In fact, if the apparatus employs the motor 76 or 176, the entire splicing operation, inclusive of delivery of successive uniting bands 3 or 103 to the splicing station WS, can be carried out in the absence of attendants.

Without further analysis, the foregoing will so fully reveal the gist of the present invention that others can, by applying current knowledge, readily adapt it for various applications without omitting features that, from the standpoint of prior art, farily constitute essential characteristics of the generic and specific aspects of our contribution to the art and, therefore, such adaptations should and are intended to be comprehended within the meaning and range of equivalence of the appended claims.

We claim:

1. Apparatus for delivering discrete adhesive-coated uniting bands to web splicing means at a web splicing station in a tobacco processing machine wherein the uniting bands adhere to and form a row on a strip-shaped flexible carrier which forms a reel of superimposed convolutions, comprising unwinding means for unwinding the strip stepwise so as to locate successive uniting bands of the row of such uniting bands in a first predetermined position; removing means for removing from the carrier that uniting band which occupies said first position, including means for advancing the band from said first to a second predetermined position; transferring means for transferring uniting bands from said second position to the web splicing means at the splicing station, said removing means comprising a member which is movable back and forth with reference to said transferring means about a predetermined axis; and means for moving said unwinding means in synchronism with said transferring means and said removing means.

2. Apparatus according to claim 1 for delivering uniting bands of the type having first and second adhesive-coated sides and further comprising means for advancing discrete first and second webs of wrapping material along predetermined first and second paths at the opposite sides of the splicing station, said transferring means being arranged to deliver uniting bands to the splicing station in such orientation that the first and second adhesive-coated sides of the uniting band at the splicing station face the adjacent portions of the respective paths.

3. The apparatus of claim 1, wherein said transferring means comprises an adhesive band holder and means for moving said holder along an arcuate path between said second position and the splicing station.

4. The apparatus of claim 3, wherein said moving means includes means for pivoting said holder about a predetermined axis.

5. The apparatus of claim 1, wherein said pivotable member includes a lever which is pivotable about a fixed axis and comprises a carrier-engaging rotary element remote from said fixed axis.

6. The apparatus of claim 5, wherein said rotary element includes an elastic biasing roller.

7. The apparatus of claim 1, wherein said transferring means includes a uniting band holder and means for moving said holder along an endless path and in a single direction from said second position to said splicing station and from said splicing station back to said second position.

8. The apparatus of claim 7, wherein said moving means comprises means for pivoting said member back and forth at least once between said first and second positions during each movement of said holder from said second position to said splicing station and back to said second position.

9. The apparatus of claim 8, wherein said moving means comprises means for actuating said unwinding means so as to move a uniting band to said first position during each movement of said holder from said second position to said splicing station and back to said second position.

10. The apparatus of claim 9, wherein said moving means comprises a transmission.

11. The apparatus of claim 1, wherein said unwinding means includes means for locating successive uniting bands in said first position in a plurality of successive stages.

12. The apparatus of claim 11, wherein said unwinding means is arranged to locate successive uniting bands in said first position in two stages.

13. The apparatus of claim 12, where in said removing means include - a holder for uniting bands and said moving means including means for pivoting said member back and forth once during each of said stages and for moving said holder from said second position to said splicing station during the first stage and from said splicing station back to said second position during the second stage of advancement of a uniting band to said first position.

14. The apparatus of claim 1, further comprising means for operating said transferring means in synchronism with said removing means and said unwinding means.

15. The apparatus of claim 14, wherein said operating means comprises a fluid-operated motor.

16. The apparatus of claim 14, further comprising a source of fresh bobbins containing supplies of webs of wrapping material, means for positioning discrete first and second webs of wrapping material in predetermined first and second paths at the opposite sides of the splicing station, means for advancing the web in one of said paths with attendant gradual expiration of the respective bobbin, means for replacing expired bobbins with fresh bobbins, and means for monitoring the webs and bobbins including means for generating signals for transmission to said operating means.

17. The apparatus of claim 16, wherein said monitoring means includes at least three signal generators.

18. The apparatus of claim 17, wherein one of said signal generators includes means for monitoring the threading of a fresh web into the apparatus.

19. The apparatus of claim 17, wherein one of said signal generators includes means for monitoring the existence or absence of the need for replacement of a bobbin.

20. The apparatus of claim 17, wherein one of said signal generators includes means for monitoring the stage of a bobbin exchange.

21. The apparatus of claim 14, wherein said operating means comprises a double-acting fluid-operated cylinder and piston unit, said unit having a reciprocable piston rod arranged to perform forward and return strokes and further comprising means for initiating the return strokes of said piston rod.

22. The apparatus of claim 21, wherein said initiating means includes a signal generator.

23. The apparatus of claim 22, wherein said signal generator includes a proximity detector switch.

24. The apparatus of claim 14, further comprising signal generating means for monitoring the transfer of uniting bands between said removing means and said transferring means and means for controlling said operating means in response to said signals.

25. The apparatus of claim 24, further comprising means for influencing said operating means in addition to said monitoring means, including means for monitoring the position of said transferring means and means for monitoring the sources of webs which are being spliced by uniting bands at said splicing station.

26. The apparatus of claim 24, wherein said monitoring means comprises a photoelectric detector.

* * * * *